United States Patent [19]

Okutsu et al.

[11] 4,435,500

[45] Mar. 6, 1984

[54] METHOD FOR DEVELOPING SILVER HALIDE PHOTOGRAPHIC LIGHT-SENSITIVE MATERIAL

[75] Inventors: Eiichi Okutsu; Nobuyuki Iwasaki; Shunji Takada, all of Kanagawa, Japan

[73] Assignee: Fuji Photo Film Co., Ltd., Kanagawa, Japan

[21] Appl. No.: 413,315

[22] Filed: Aug. 31, 1982

[30] Foreign Application Priority Data

Aug. 31, 1981 [JP] Japan ..... 56-136267

[51] Int. Cl.[3] ..... G03C 5/38

[52] U.S. Cl. ..... 430/419; 430/502; 430/596; 430/456; 430/489

[58] Field of Search ..... 430/419, 502, 456, 567, 430/489, 596, 599, 571

[56] References Cited

U.S. PATENT DOCUMENTS

| | | | |
|---|---|---|---|
| 2,996,382 | 8/1961 | Luckey et al. | 430/502 |
| 3,178,282 | 4/1965 | Luckey et al. | 430/502 |
| 3,397,987 | 8/1968 | Luckey et al. | 430/603 |
| 3,607,278 | 9/1971 | Ditzer et al. | 430/567 |
| 3,708,300 | 1/1973 | Luckey | 430/505 |

OTHER PUBLICATIONS

Mees, Third Edition Theory of Photographic Process, pp. 344–346.

*Primary Examiner*—Mary F. Downey

*Attorney, Agent, or Firm*—Sughrue, Mion, Zinn, Macpeak and Seas

[57] ABSTRACT

A method of rapidly processing a silver halide photographic light-sensitive material having high sensitivity and high covering power using a developing solution is disclosed. The developing solution contains a combination of a silver halide solvent and a particular anti-foggant. The rapid processing is not attended by increase in fog and deterioration of graininess. The photographic material contains a surface latent image type silver halide emulsion and a silver halide emulsion having fogged nuclei inside the grains in a single layer formed by coating the mixture thereof, or in a double layer formed by coating them separately. The anti-foggant has the general formula (I) or (II):

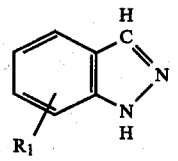

(I)

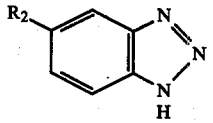

(II)

wherein $R_1$ represents hydrogen, a nitro group, a cyano group or a halogen atom; and $R_2$ represents hydrogen, a halogen atom or an alkyl group.

7 Claims, No Drawings

METHOD FOR DEVELOPING SILVER HALIDE PHOTOGRAPHIC LIGHT-SENSITIVE MATERIAL

FIELD OF THE INVENTION

The present invention relates to a developing method for a silver halide photographic light-sensitive material and more particularly, to a method for rapidly processing a silver halide film having high sensitivity and high covering power without deterioration of graininess and increase of fog.

BACKGROUND OF THE INVENTION

In a photographic image consisting of silver, the ratio of the optical density of the image to the amount of image-constituting silver per unit area is generally called the covering power. The covering power is adopted as a measured of evaluating the optical efficiency of the image-constituting silver. The covering power of a silver halide photographic light-sensitive layer is, in general, increased by a decrease in the size of the silver halide grains. The grain size is generally represented by a diameter or a reduced diameter. The covering power is, in general, decreased by an increase in the size of the silver halide grains. On the other hand, an increase in the size silver halide grains can, in general, increase the sensitivity of a silver halide emulsion layer. Therefore, a silver halide emulsion having a large grain size is employed in highly sensitive photographic materials. Consequently, the highly sensitive photographic material requires a larger amount of silver per unit area in order to attain a prescribed image density. More specifically, a photographic material must contain a larger amount of silver halide per unit area in order to attain both high sensitivity and maximum image density. Accordingly, a large amount of silver is used in preparing conventional highly sensitive photographic materials.

An attempt to improve upon the covering power while maintaining high sensitivity is disclosed in British Pat. Nos. 1,048,057 and 1,039,471, and U.S. Pat. Nos. 3,043,697 and 3,446,618. These patents describe a technique of adding various kinds of polymers to highly sensitive coarse grain silver halide emulsions. However, the addition of such polymers has been found to be insufficient with respect to improvement in the covering power. Furthermore, the addition of these polymers lowers the stength of coated films.

When photographic materials constituted with coated films having low mechanical strength are processed using a general present-day automatic developing machine, a noticeable amount of the gelatin contained in the coated films dissolves out into the developing solution or the fixing solution. The dissolved gelatin comes to adhere to the conveying roller of the automatic developing machine. The thus adhered gelatin is then transferred onto photographic materials causing stains on photographic images. Therefore, such a technique is not considered to be suitable for the above-described purpose.

On the other hand, U.S. Pat. Nos. 2,996,382 and 3,178,282 describe another method for producing photographic images of high sensitivity, high contrast and high covering power. The method described in these patents comprises using a silver halide photographic material having surface latent image type silver halide coarse grains and silver halide fine grains having fogged nuclei inside thereof in the same layer or in adjacent layers separately. According to this method, it was believed that the surface latent image type silver halide coarse grains are at first developed, and the resulting development products attack the silver halide fine grains, which have fogged nuclei inside thereof, present in the neighborhood of the products to cause development of the fine grains. However, when such a photographic material as described above is processed with a developing solution having a conventional formula, it requires too long of a developing time to be of practical use. Accordingly, the above-described U.S. Patents disclose the addition of silver halide solvents, such as potassium thiocyanate, thiosulfates and so on, to conventional developing solutions. However, as described in each of the above referred to U.S. Patents, reduction of developing time is achieved by such a method, but graininess of image is deteriorated and fog is increased. This defect cannot be remedied by the addition of generally used anti-fogging agents (e.g., mercaptotetrazoles).

SUMMARY OF THE INVENTION

A primary object of the present invention is to provide a method for rapidly developing a photographic image having high sensitivity.

Another object of the invention is to provide a process for developing a photographic material wherein the developed image will have high contrast.

Yet another object of the present invention is to provide a method of developing a photographic image in order to provide high convering power without any deterioration of graininess or increase in fog.

Another object of the present invention is to provide a method for developing a photographic image wherein the photographic material utilized contains a reduced amount of silver, but which retains high sensitivity, high contrast, and high covering power and does not result in deterioration of graininess or increased fog.

The above-described objects are attained by processing a silver halide photographic material, which contains a surface latent image type silver halide emulsion and a silver halide emulsion containing fogged nuclei inside the grains in a single layer formed by coating the mixture thereof, or in a double layer formed by coating these emulsions separately, with a developing solution containing (i) a silver halide solvent and (ii) a compound represented by the following general formula (I) or (II):

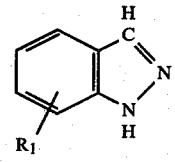

(I)

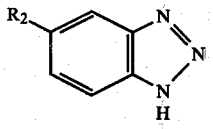

(II)

wherein $R_1$ represents hydrogen, a nitro group, a cyano group or a halogen atom; and $R_2$ represents hydrogen, a halogen atom or an alkyl group.

DETAILED DESCRIPTION OF THE INVENTION

The surface latent image type silver halide emulsion employed in a photographic material to which the developing method of the present invention is to be applied means an emulsion of the kind which, when exposed to light for a period of 1 to 1/100 second and then developed according to the surface developing process (A) described hereinafter or the internal developing process (B) described hereinafter, can exhibit higher sensitivity by the surface developing process (A) than by the internal developing process (B) and, more preferably, can exhibit higher sensitivity by the former process (A) than by the latter process (B) by a factor of 2 or more.

Herein, the sensitivity is defined as follows:

$$S=100/Eh$$

[wherein S represents the sensitivity, and Eh represents an exposure necessary to acquire the density corresponding to the middle position between the maximum density ($D_{max}$) and the minimum density ($D_{min}$), i.e., $\frac{1}{2}(D_{max}+D_{min})$].

Surface Developing Process (A)

The process comprises developing a photographic material with a developing solution having the following formula at a temperature of 20° C. for a period of 10 minutes.

Formula of Developing Solution

| | |
|---|---|
| N—Methyl-p-aminophenol (hemisulfate) | 2.5 g |
| Ascorbic Acid | 10 g |
| Sodium Metaborate Tetrahydrate | 35 g |
| Potassium Bromide | 1 g |
| Water to make | 1 l |

Internal Developing Process (B)

The process comprises, in sequence, processing a photographic material with a bleaching solution containing 3 g/l of hexacyanoferrate (III) and 0.0126 g/l of phenosafranine at a temperature of about 20° C. for a period of 10 minutes, washing it with water for a period of 10 minutes, and developing it with a developing solution of the following formula at a temperature of 20° C. for a period of 10 minutes.

Formula of Developing Solution

| | |
|---|---|
| N—Methyl-p-aminophenol (hemisulfate) | 2.5 g |
| Ascorbic Acid | 10 g |
| Sodium Metaborate Tetrahydrate | 35 g |
| Potassium Bromide | 1 g |
| Sodium Thiosulfate | 3 g |
| Water to make | 1 l |

Suitable examples of the surface latent image type silver halide include those containing a silver iodide. Specifically, silver chloroiodide, silver iodobromide and silver chloroiodobromide can be preferably employed. The silver iodide is preferably contained in the surface latent image type silver halide in an amount of from 0.1 to 30 mol% and particularly from 0.5 to 10 mol%. The mean grain size of the surface latent image type silver halide is preferably larger than that of a silver halide emulsion having fogged nuclei inside the grains and, more particularly, larger than 0.6 μm. Therein, it does not matter whether its grain size distribution is narrow or wide. Silver halide grains in the emulsion may have a regular crystal form, such as cubic, octahedron or like, or an irregular crystal form, such as balls, plates or so on. Further, they may have a complex form of two or more of these crystal forms. In addition, they may be a mixture of grains differing in crystal form.

Photographic emulsions used in the present invention can be made by methods described in, for example, P. Glafkides, *Chimie et Physique Photographique,* Paul Montel, Paris (1967), C. F. Duffin, *Photographic Emulsion Chemistry,* The Focal Press, London (1966), V. L. Zelikman et al., *Making and Coating Photographic Emulsion,* The Focal Press, London (1964) and so on. That is to say, any method, which includes the acid process, the neutral process, the ammonia process and so on, can be employed. A soluble silver salt may be reacted with a soluble halide by a method such as a single jet process, a double jet process, or the combination thereof.

In addition, a process of producing grains under excess silver ion (a so-called reversal mixing process) can also be adopted. Further, it is possible to use a process which is one form of the double jet process and comprises maintaining a pAg value constant in the liquid phase where silver halide grains continue to be produced, that is, a so-called controlled double jet process.

According to the controlled double jet process, the grains produced have a regular crystal form and their sizes are nearly uniform.

Two or more silver halide emulsions prepared separately according to different methods may be used in the form of a mixture.

The step of forming silver halide grains or the step of ripening physically them may be carried out in the copresence of a salt such as a cadmium salt, a zinc salt, a lead salt, a thallium salt, an iridium salt or the complex thereof, a rhodium salt or the complex thereof, an iron salt or the complex thereof.

Silver halide emulsions having fogged nuclei inside the grains which can be employed in a photographic material to which the developing method of the present invention is to be applied include emulsions of the kind of which, when coated on a transparent support at a coverage of 2 g silver per square meter to make a test piece and developed with D-19 (which is the developer specified by Eastmen Kodak Co.) at 35° C. for 2 minutes without receiving optical exposure in advance, can provide a transmission density of fog not higher than 0.5 (exclusive of the density of the support itself) and that, when made into the same test piece as described above and developed with the developing solution prepared by adding 0.5 g/l of potassium bromide to D-19 at 35° C. for 2 minutes without receiving optical exposure in advance, can provide a transmission density of fog not lower than 1.0 (exclusive of the density of the support itself).

The silver halide emulsions having fogged nuclei inside the grains can be prepared using various known methods. Examples of the method for fogging silver halide grains include a method of irradiating the grains with light or X-rays, a method of forming fogged nuclei chemically using a reducing agent, a gold compound or a sulfur-containing compound, and a method of making the emulsion under the condition of low pAg and high pH. In order to form fogged nuclei only inside the grains, it is possible to use a technique wherein both the interior and the surface of the silver halide grains are fogged using one of the above-described methods and then the fogged nuclei formed at the surface part are bleached with a solution of a hexacyanoferrate (III). In accordance with another technique which is more preferable than the former one, a core emulsion having fogged nuclei is made using the method of making an emulsion under the condition of low pAg and high pH or the method of forming fogged nuclei chemically and covering the core emulsion with a shell emulsion. Methods for making such a core-shell emulsion are known and described in publications such as U.S. Pat. No. 3,206,313 which is incorporated herein by reference to disclose a method preparing such an emulsion.

A silver halide emulsion having fogged nuclei inside the grains has a smaller mean grain size than a surface latent image type silver halide emulsion, and a preferable mean grain size thereof is 0.5 μm or less, more preferably 0.4 μm or less.

The above-described two kinds of silver halide emulsions may be mixed, and coated in a single layer, or they may be coated separately to form a double layer. The thus coated silver halide emulsions are used as a silver halide photographic material. The ratio of the surface latent image type silver halide emulsion to the silver halide emulsion having fogged nuclei inside the grains ranges from 10:1 to 1:10 and more particularly 5:1 to 1:5, by weight (reducing amount of silver). This ratio is used, even if the emulsions form either a single layer or a double layer. There are no specific restrictions with respect to the coverage of silver. However, in accordance with the method of the present invention, satisfactory photographic characteristics including covering power, sensitivity and so on can be attained with very sparse coverage of silver ranging from 2 g/m$^2$ to 5 g/m$^2$.

Developing solutions used in the developing method of the present invention are characterized by containing both (i) a silver halide solvent and (ii) a compound represented by the general formula (I) or (II). Except for containing components (i) and (ii), the developing solutions have the same compositions as general silver halide photographic developing solutions, such as aqueous solutions containing one or more developing agents such as 1-phenyl-3-pyrazolidone and its derivatives, N-methyl-p-aminophenol, hydroquinone and so on. In addition to the developing agents, the solutions may also contain known additives for developing solutions. Specific examples of such additives include an oxidation inhibitor like sodium sulfite or ascorbic acid, a pH controlling agent and a buffer such as salts like sodium sulfate and so on, boric acid, borax, sodium hydroxide, sodium carbonate and sodium tertiary phosphate, a development inhibitor such as sodium bromide and potassium iodide, an aldehyde series hardener such as formalin and glutaraldehyde, an organic solvent such as triethylene glycol and hexylene glycol.

There are no particular restrictions on the pH of the developing solution. However, the pH preferably ranges between 9.0 to 11.5.

Silver halide solvents used in the present invention can be selected from various known ones. Known silver halide solvents include rhodanates such as potassium rhodanate, sodium rhodanate, ammonium rhodanate and the like, thiosulfates, quaternary ammonium salt such as 1-methylpyridinium chloride, 1-ethylpyridinium bromide and the like, and imidazole derivatives represented by the following general formula are particularly preferable because they can increase the developing speed to a great extent:

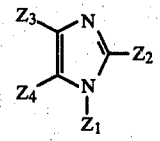

wherein $Z_1$ to $Z_4$ may be the same or different, and they each represents hydrogen, an alkyl group, a hydroxyalkyl group or an alkenyl group.

As for the alkyl group, the hydroxyalkyl group and the alkenyl group represented by the above-described $Z_1$ to $Z_4$, those having up to 5 carbon atoms are suitable for each of these groups. Specific examples of useful $Z_1$ to $Z_4$ substituents include: a methyl group, an ethyl group, a propyl group, an i-propyl group, a butyl group, an amyl group, an isoamyl group, a hydroxymethyl group, a hydroxyethyl group, a hydroxypropyl group, a vinyl group, an allyl group and the like.

Specific examples of the above-described imidazole derivatives include imidazole, 2-methylimidazole, 2,4-dimethylimidazole, 2-ethyl-4-methylimidazole, 2-amylimidazole, 1-isoamyl-2methylimidazole, 4,5-dimethylimidazole, 2-ethylimidazole, 1-ethylimidazole, 2,4,5-trimethylimidazole, 4-hydroxymethyl-5-methylimidazole, 4-(2-hydroxyethyl)-5-methylimidazole, 1-allyl-2-methylimidazole and 1-vinyl-2-methylimidazole.

The amount of silver halide solvent added is properly selected depending on what kind of compound is employed. In general, silver halide solvent is added in a concentration ranging from 0.01 g to 10 g, and preferably from 0.05 g to 4 g, per liter of the developing solution, with good results.

The use of a compound represented by the general formula (I) or (II) has a strong effect on eliminating graininess and fog due to the addition of the above-described silver halide solvents, especially rhodanates, thiosulfates and quaternary ammonium salts. The imidazole compounds having the above-described general formula can increase the developing speed without increasing graininess and/or fog. The combined use of such an imidazole compound as described above and the compound represented by the general formula (I) or (II) of the present invention can contribute to rapid achievement of reduced graininess and fog.

The compounds represented by the general formula (I) or (II) are now illustrated in detail below:

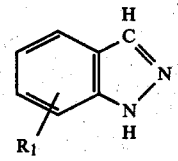

(I)

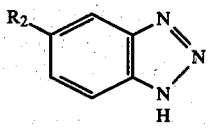

(II)

Therein, $R_1$ represents hydrogen, a nitro (—$NO_2$) group, a cyano (—CN) group or a halogen atom (including chlorine atom, bromine atom and iodine atom), and $R_2$ represents hydrogen, a halogen atom (including chlorine atom, bromine atom and iodine atom) or an alkyl group (preferably a lower alkyl group containing 1 to 5 carbon atoms, especially a methyl group or an ethyl group).

Specific examples of the compound represented by the general formula (I) include indazole, 5-nitroindazole, 6-nitroindazole, 5-cyanoindazole, 5-chloroindazole and the like, and those of the compound represented by the general formula (II) include benzotriazole, 5-methylbenzotriazole, 5-chlorobenzotriazole, 5-bromobenzotriazole and the like. Among the compounds represented by the general formula (I) or (II), 5-nitroindazole or 5-methylbenzotriazole is most preferred.

The amount of the compound added can be changed according to the effectiveness of the compound. As a guide, the compound is generally added in a concentration of 0.01 g to 10.0 g, and preferably 0.02 g to 5.0 g, per liter of developing solution. These concentrations have been found to be effective.

When processing with the above-described developing solution, the developing time and developing temperature depend on the photographic material used. However, in general, the time is preferably within the range of 10 seconds to 2 minutes and the temperature is within the range of 20° C. to 45° C., respectively. Fixing and washing steps can be carried out in the same manners as those adopted generally in conventional silver halide photographic materials.

According to the developing method of the present invention the above-described silver halide photographic material specified in the present invention is processed with developing solution containing (i) the silver halide solvent and (ii) the compound represented by the general formula (I) or (II). The photographic image obtained has high sensitivity and low fog density and is obtained in a short developing time without being attended by deterioration of graininess.

The present invention will now be illustrated in greater detail by reference to the following examples. However, the invention is not limited to these specific embodiments.

EXAMPLE 1

An aqueous solution (1 l) containing 80 g of potassium bromide, 2 g of potassium iodide and 10 g of gelatin was kept at a temperature of 60° C. and thereto an aqueous solution of silver nitrate (100 g/l) was added taking 30 minutes to make a silver iodobromide emulsion having a mean grain size of 1.4 μm. After desalting in a conventional manner, the emulsion was submitted to chemical ripening at 60° C. for 75 minutes through the addition of $2\times10^{-5}$ mol/mol $Ag^+$ of sodium thiosulfate and $1\times10^{-5}$ mol/mol $Ag^+$ of chloroauric acid. The thus obtained emulsion was of the surface latent image type. This emulsion is referred to as Emulsion I.

A mixed aqueous solution of potassium bromide and potassium iodide and an aqueous solution of silver nitrate were simultaneously added to a gelatin aqueous solution maintained at a temperature of 50° C. taking 50 minutes to make silver iodobromide core grains measuring 0.25 μm in size and containing 2 mol% of iodine. Thereto, silver nitrate was further added in such an amount as to adjust the pAg to 5.0 and, furthermore, sodium hydroxide was added in order to adjust the pH to 9.5. Then, the core grains were fogged at their surface parts by adding thereto $1\times10^{-5}$ mol/mol $Ag^+$ of chloroauric acid and then ripening them at 50° C. for 60 minutes. To the thus obtained emulsion, a mixed aqueous solution of potassium bromide and potassium iodide and an aqueous solution of silver nitrate were simultaneously further added taking 30 minutes to put a shell on the individual core grain, resulting in the preparation of an internally fogged emulsion measuring 0.3 μm in size and containing 2 mol% of iodide. The thus prepared silver halide emulsion having fogged nuclei inside the grains is referred to as Emulsion II.

Emulsion I alone was coated on a polyethylene terephthalate support at a coverage of 3.6 g silver per square meter to prepare a film sample 1. Separately, Emulsion I and Emulsion II were mixed in a ratio of 50:50 by silver content, and coated on a polyethylene terephthalate support at a coverage of 3.6 g silver per square meter to prepare a film sample 2. Each of these film samples was exposed to light through an optical wedge for 1/10 second, and development-processed at 35° C. with each of the following developing solutions:

Developing Solution A

| | |
|---|---|
| 1-Phenyl-3-pyrazolidone | 0.5 g |
| Hydroquinone | 20.0 g |
| Disodium Ethylenediaminetetraacetate | 2.0 g |
| Potassium Sulfite | 60.0 g |
| Boric Acid | 4.0 g |
| Potassium Carbonate | 20.0 g |
| Sodium Bromide | 5.0 g |
| Diethylene Glycol | 30.0 g |
| Water to make | 1 l |
| Sodium Hydroxide to adjust the pH to | 10.0 |

Developing Solution B

Solution B was prepared by adding 0.025 mol/l of potassium rhodanate to the Developing Solution A.

Developing Solution C

Solution C was prepared by adding 0.025 mol/l of potassium rhodanate and 80 mg/l of 5-nitroindazole to the Developing Solution A.

Developing Solution D

Solution D was prepared by adding 0.025 mol/l of potassium rhodanate and 70 mg/l of 5-methylbenzotriazone to the Developing Solution A.

Developing Solution E

Solution E was prepared by adding 0.025 mol/l of potassium rhodanate, 40 mg/l of 5-nitroindazole and 35 mg/l of 5-methylbenzotriazole to the Developing Solution A.

Developing Solution F

Solution F was prepared by adding 0.025 mol/l of potassium rhodanate and 90 mg/l of 1-phenyl-5-mercaptotetrazole to the Developing Solution A.

The results obtained are shown in Table 1.

TABLE 1

| Remark | Film Sample | Developing Solution | Developing Time (sec) | Fog | Sensitivity | Maximum Density | Graininess |
|---|---|---|---|---|---|---|---|
| Comparative | 1 | A | 25 | 0.04 | 100 | 1.3 | 4 |
| Example | 1 | A | 50 | 0.06 | 110 | 1.3 | 4 |
| | 1 | A | 75 | 0.08 | 120 | 1.3 | 4 |
| Comparative | 1 | B | 25 | 0.04 | 110 | 1.3 | 4 |
| Example | 1 | B | 50 | 0.06 | 120 | 1.3 | 4 |
| | 1 | B | 75 | 0.08 | 130 | 1.3 | 4 |
| Comparative | 1 | C | 25 | 0.03 | 110 | 1.3 | 4 |
| Example | 1 | C | 50 | 0.05 | 120 | 1.3 | 4 |
| | 1 | C | 75 | 0.07 | 130 | 1.3 | 4 |
| Comparative | 1 | D | 25 | 0.03 | 110 | 1.3 | 4 |
| Example | 1 | D | 50 | 0.05 | 120 | 1.3 | 4 |
| | 1 | D | 75 | 0.07 | 130 | 1.3 | 4 |
| Comparative | 1 | E | 25 | 0.03 | 110 | 1.3 | 4 |
| Example | 1 | E | 50 | 0.05 | 120 | 1.3 | 4 |
| | 1 | E | 75 | 0.07 | 130 | 1.3 | 4 |
| Comparative | 1 | F | 25 | 0.03 | 110 | 1.3 | 4 |
| Example | 1 | F | 50 | 0.05 | 120 | 1.3 | 4 |
| | 1 | F | 75 | 0.07 | 130 | 1.3 | 4 |
| Comparative | 2 | A | 25 | 0.06 | 120 | 2.0 | 4 |
| Example | 2 | A | 50 | 0.08 | 140 | 2.4 | 4 |
| | 2 | A | 75 | 0.10 | 160 | 2.8 | 4 |
| Comparative | 2 | B | 25 | 0.16 | 160 | 2.8 | 3 |
| Example | 2 | B | 50 | 0.18 | 180 | 3.0 | 3 |
| | 2 | B | 75 | 0.20 | 200 | 3.2 | 2 |
| Present | 2 | C | 25 | 0.06 | 160 | 2.8 | 4 |
| Invention | 2 | C | 50 | 0.08 | 180 | 3.0 | 4 |
| | 2 | C | 75 | 0.10 | 200 | 3.2 | 4 |
| Present | 2 | D | 25 | 0.06 | 160 | 2.8 | 4 |
| Invention | 2 | D | 50 | 0.08 | 180 | 3.0 | 4 |
| | 2 | D | 75 | 0.10 | 200 | 3.2 | 4 |
| Present | 2 | E | 25 | 0.06 | 160 | 2.8 | 4 |
| Invention | 2 | E | 50 | 0.08 | 180 | 3.0 | 4 |
| | 2 | E | 75 | 0.10 | 200 | 3.2 | 4 |
| Comparative | 2 | F | 25 | 0.13 | 160 | 2.8 | 3 |
| Example | 2 | F | 50 | 0.15 | 180 | 3.0 | 3 |
| | 2 | F | 75 | 0.17 | 200 | 3.2 | 2 |

The fog values in Table 1 were determined by measuring the diffuse density of visible light. Sensitivity values were represented by the reciprocals of relative exposures required for providing the density of fog value+1.0, and the case that the film sample 1 was developed with the Developing Solution A at 35° C. for 25 seconds was taken as 100 (standard), and the other cases are relative values thereof. The maximum density represents optical density under a large quantity of exposure. The graininess was ranked by visual evaluation. The rank 4 means good graininess, the rank 3 an allowable one, the rank 2 a bad one, and the rank 1 a very bad one.

As can be seen from Table 1, film sample 1 can only provide a maximum density of 1.3. On the other hand, film sample 2 can provide higher maximum densities than that of film sample 1 and can exhibit high sensitivity even when Developing Solution A, which has generally been used, is used. In particular, it should be noted that elongation of developing time brings about an increase in sensitivity. These results are the same as described in U.S. Pat. No. 2,996,382. In addition, the use of Developing Solution B wherein potassium rhodanate is used as a silver halide solvent, which is also described in the above-cited U.S. patent, can increase the sensitivity, but causes a marked increase in fog density and aggravates the graininess. On the other hand, Developing Solutions C, D and E each of which contains the combination of potassium rhodanate and the compound represented by the general formula (I) or (II) of the present invention have excellent effects. More specifically, the generation of fog and deterioration of graininess are suppressed, and sensitivity is heightened. It is also apparent from Table 1 that when the compound represented by the general formula (I) or (II), which each has been known as an anti-foggant for silver halides, is employed for development of the film sample 2 which contains the mixture of Emulsion I and Emulsion (II) (50%:50%), the anti-fogging effect of the compound is especially remarkable. However, when using Developing Solution F which includes 1-phenyl-5-mercaptotetrazole (a well-known anti-foggant), for comparison, the anti-fogging effect on the film sample 2 was found to be insufficient. Accordingly, the compounds represented by the general formula (I) or (II) have proved to be especially advantageous.

EXAMPLE 2

The same film sample 2 as prepared in Example 1 was development-processed using each of Developing Solutions G, H, I, J, K and L described below under each of conditions, i.e., at 35° C. for 25 seconds, at 35° C. for 50 seconds and at 35° C. for 75 seconds. The developed films were subsequently submitted to fixing, washing and drying processings.

Developing Solution G

| | |
|---|---|
| 4,4-Dimethyl-1-phenyl-3-pyrazolidone | 0.6 g |
| Hydroquinone | 25.0 g |
| Disodium Ethylenediaminetetraacetate | 2.0 g |
| Potassium Sulfite | 55.0 g |
| Boric Acid | 2.0 g |
| Sodium Carbonate | 25.0 g |
| Potassium Bromide | 4.0 g |
| Water to make | 1 l |

-continued

| | |
|---|---|
| Potassium Hydroxide to adjust pH to | 10.2 |

Developing Solution H

Solution H was prepared by adding 0.04 mol/l of 2-methylimidazole to the Developing Solution G.

Developing Solution I

Solution I was prepared by adding 0.02 mol/l of 2-methylimidazole and 40 mg/l of 5-nitroindazole to the Developing Solution G.

Developing Solution J

Solution J was prepared by adding 0.02 mol/l of 2-methylimidazole and 35 mg/l of 5-methylbenzotriazole to the Developing Solution G.

Developing Solution K

Solution K was prepared by adding 0.02 mol/l of 2-methylimidazole, 20 mg/l of 5-nitroindazole and 20 mg/l of 5-methylbenzotriazole to the Developing Solution G.

Developing Solution L

Solution L was prepared by adding 0.02 mol/l of 2-methylimidazole and 45 mg/l of 1-phenyl-5-mercaptotetrazole to the Developing Solution G.

The results obtained are shown in Table 2.

TABLE 2

| Remark | Film Sample | Developing Solution | Developing Time (sec) | Fog | Sensitivity | Maximum Density | Graininess |
|---|---|---|---|---|---|---|---|
| Comparative Example | 2 | G | 25 | 0.07 | 130 | 2.1 | 4 |
| | 2 | G | 50 | 0.09 | 150 | 2.5 | 4 |
| | 2 | G | 75 | 0.11 | 170 | 2.9 | 4 |
| Comparative Example | 2 | H | 25 | 0.10 | 200 | 3.2 | 3.5 |
| | 2 | H | 50 | 0.12 | 220 | 3.2 | 3.5 |
| | 2 | H | 75 | 0.14 | 240 | 3.2 | 3.5 |
| Present Invention | 2 | I | 25 | 0.07 | 210 | 3.2 | 4 |
| | 2 | I | 50 | 0.09 | 230 | 3.2 | 4 |
| | 2 | I | 75 | 0.11 | 240 | 3.2 | 4 |
| Present Invention | 2 | J | 25 | 0.07 | 210 | 3.2 | 4 |
| | 2 | J | 50 | 0.09 | 230 | 3.2 | 4 |
| | 2 | J | 75 | 0.11 | 240 | 3.2 | 4 |
| Present Invention | 2 | K | 25 | 0.07 | 210 | 3.2 | 4 |
| | 2 | K | 50 | 0.09 | 230 | 3.2 | 4 |
| | 2 | K | 75 | 0.11 | 240 | 3.2 | 4 |
| Comparative Example | 2 | L | 25 | 0.14 | 210 | 3.2 | 4 |
| | 2 | L | 50 | 0.16 | 230 | 3.2 | 4 |
| | 2 | L | 75 | 0.18 | 240 | 3.2 | 4 |

Fog, sensitivity, maximum density and graininess described in Table 2 have the same meanings as defined in Table 1, respectively. As for the Developing Solutions G and H employed for comparison, the Developing Solution H provides higher sensitivity and higher maximum density than the Developing Solution G, but it is attended by increased fog and deterioration of graininess to some extent.

The Developing Solutions I, J and K of the present invention, each of which contains a combination of silver halide solvent and a compound represented by the general formula (I) or (II), were found to be advantageous. These solutions markedly reduce fog and maintain high sensitivities and high maximum densities. However, when using Developing Solution L which includes 1-phenyl-5-mercaptotetrazole (a well known anti-fogging agent) for comparison, the anti-fogging effect on film sample 2 was found to be insufficient.

Accordingly, the compounds represented by the general formula (I) or (II) of the present invention have proved to be especially advantageous.

The surface latent image type silver halide emulsions to be employed in photographic materials to which the developing method of the present invention can be applied can be chemically sensitized by conventional methods. Suitable examples of chemical sensitizers which can be used in the present invention include gold compounds such as chloroaurates, gold trichloride and the like, as described in U.S. Pat. Nos. 2,399,083, 2,540,085, 2,597,856 and 2,597,915; salts of noble metals such as platinum, palladium, iridium, rhodium, ruthenium and the like, as described in U.S. Pat. Nos. 2,448,060, 2,540,086, 2,566,245, 2,566,263 and 2,598,079; sulfur compounds capable of producing silver sulfide by the reaction with silver salts, as described in U.S. Pat. Nos. 1,574,944, 2,410,689, 3,189,458, 3,501,313 and so on; and stannous salts, amines and other reducing substances, as described in U.S. Pat. Nos. 2,487,850, 2,518,698, 2,521,925, 2,521,926, 2,694,637, 2,983,610 and 3,201,254.

It is preferable for the silver halide emulsions having fogged nuclei inside the grains to receive no chemical sensitization treatment. However, they may be subjected to chemical sensitization in the same manner as described in the surface latent image type emulsions.

Suitable examples of hydrophilic colloids which can be used in each of the two types of photographic emulsions to be employed in the present invention include gelatin, colloidal albumin, casein, cellulose derivatives such as carboxymethyl cellulose, hydroxyethyl cellulose, etc., sugar derivatives such as agar, sodium alginate, starch derivatives, etc., and synthetic hydrophilic colloids such as polyvinyl alcohol, poly-N-vinylpyrrolidone, acrylic acid copolymers, polyacrylamide, derivatives of these polymers and partially hydrolyzed products of these polymers. These colloids may be optionally used in a mixed form of two or more thereof compatible with one another. The most generally used colloid is gelatin. However, a part or all of the gelatin can be replaced by synthetic high polymers and, further, a so-called gelatin derivatives may be used instead of gelatin.

Photographic emulsions to be employed in the present invention may be spectrally sensitized with dyes such as methine dyes. Such dyes may be used individually or in combination thereof. Combinations of such dyes have been frequently used especially for the purpose of supersensitization. The photographic emulsions may further contain dyes which themselves have no spectral sensitizing effects, and substances which exhibit substantially no absorption in the visible region, but exhibit supersensitization effects in combination with sensitizing dyes.

Useful sensitizing dyes, combinations of dyes for exhibiting supersensitizing effects, and substances capable of exhibiting supersensitization effects in combination with sensitizing dyes are described in *Research Disclosure,* Vol. 176, No. 17643, page 23, Term IV-J (Dec. 1978).

Various additives can be added to the photographic emulsions of the present invention. These additives may serve to prevent fog from being generated in the course of preparation, storage or photographic processings, or to stabilize photographic characteristics. Specific examples of such additives include various kinds of compounds known as an anti-foggant or a stabilizer, such as azoles (e.g., benzothiazolium salts, nitrobenzimidazoles, chlorobenzimidazoles, bromobenzimidazoles, mercaptothiazoles, mercaptobenzothiazoles, mercaptobenzimidazoles, mercaptothiadiazoles, nitrobenzotriazoles, mercaptotetrazoles (especially 1-phenyl-5-mercaptotetrazole), etc.); mercaptopyrimidines; mercaptotriazines; thioketo compounds such as oxazolinethione; azaindenes such as triazaindenes, tetraazaindenes (especially 4-hydroxy-1,3,3a,7-tetraazaindenes), pentaazaindenes and the like; benzenethiosulfonic acid; benzenesulfinic acid; and benzenesulfonic acid amide.

Photographic emulsions which can be employed in the present invention may contain inorganic or organic hardeners. Suitable examples of such hardeners include chromium salts (e.g., chrome alum, chromium acetate, etc.), aldehydes (e.g., formaldehyde, glyoxal, glutaraldehyde, etc.), N-methylol compounds (e.g., dimethylol urea, methylol dimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and so on. They may be used independently or in any combination.

Photographic emulsions which can be employed in the present invention may contain various kinds of surface active agents for a wide variety of purposes. These agents may serve as a coating aid, to prevent the generation of static charges, improve slipperability, emulsify the dispersion, prevent adhesion, or improve photographic characteristics (e.g., acceleration of development, heightening of image contrast, sensitization, etc.) and so on.

Examples of suitable surface active agents include nonionic surface active agents, such as saponin (steroid series), alkylene oxide derivatives (e.g., polyethylene glycol, polyethylene glycol/polypropylene glycol condensates, polyethylene glycol alkyl ethers, polyethylene glycol alkyl aryl ethers, polyethylene glycol esters, polyethylene glycol sorbitan esters, polyalkylene glycol alkylamines or amides, polyethylene glycol adducts of silicone, etc.), glycidol derivatives (e.g., alkenyl succinic acid polyglycerides, alkylphenol polyglycerides, etc.), fatty acid esters of polyhydric alcohols, alkyl esters of saccharides, and so on; anionic surface active agents containing acidic groups such as carboxylic group, sulfo group, phospho group, sulfate group, phosphate group and the like, for example, alkyl carboxylates, alkyl sulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkyl phenyl ethers, polyoxyethylene alkylphosphoric acid esters and so on; amphoteric surface active agents such as amino acids, aminoalkylsulfonic acids, aminoalkylsulfuric or aminoalkylphosphoric acid esters, alkyl betanins, amine oxides and so on; and cationic surface active agents such as alkylamine salts, aliphatic or aromatic quaternary ammonium salts, heterocyclic quaternary ammonium salts such as pyridinium, imidazolium and the like, aliphatic or heterocyclic ring-containing phosphonium or sulfonium salts, and so on.

In addition, for the purpose of preventing photographic materials from generating static charges, it is effective to incorporate into their constituent layers such polymers as described in U.S. Pat. Nos. 2,882,157, 2,972,535, 3,062,785, 3,262,807, 3,514,291, 3,615,531, 3,753,716, 3,938,999, 3,988,158, 4,118,231, 4,126,467 and 4,200,465, British Pat. Nos. 1,235,075, 1,155,977, 1,461,438, 1,352,975, 1,484,868 and 1,535,685, and so on; such polymer latexes as described in U.S. Pat. Nos. 4,070,189 and 4,147,550, and so on; zinc oxide, semiconductors and colloidal silica as described in U.S. Pat. Nos. 3,062,700, 3,245,835 and 3,525,621; and so on.

Photographic materials to which the developing method of the present invention is to be applied are prepared by coating the above-described photographic emulsion layers and other layers on generally used flexible supports such as plastic films, paper, cloth and the like, or rigid supports such as glass, ceramics, metal and the like. Specific examples of supports useful as flexible ones include films made of semisynthetic or synthetic high polymers such as cellulose nitrate, cellulose acetate, cellulose acetate butyrate, polystyrene, polyvinyl chloride, polyethylene terephthalate, polycarbonate and so on; paper coated or laminated with baryta or $\alpha$-olefin polymer (e.g., polyethylene, polypropylene, ethylene-butene copolymer, etc.); and so on. The support may be colored by adding pigments or dyes thereto. With the intention of intercepting light, it may be rendered black. The surface of such a support as described above has, in general, a subbing layer thereon for the purpose of increasing adhesiveness to photographic emulsion layers. The support may be subjected to such a surface treatment as corona discharge, irradiation with ultraviolet rays, flame treatment or so on before or after the subbing layer is provided.

In addition to the above-described additives, various kinds of known materials and other additives may be incorporated in photographic materials to be employed in the present invention. For details thereof, *Research Disclosure,* No. 17643 can be referred to.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic light-sensitive material, comprising the steps of:

(a) providing a silver halide photographic light-sensitive material comprising a support having thereon a surface latent image type silver halide emulsion and a silver halide emulsion containing fogged nuclei inside the grains;

(b) exposing the photographic material to light; and (c) developing the exposed photographic material in a developing solution comprising:

(i) a silver halide solvent, wherein said silver halide solvent is an imidazole derivative represented by the formula:

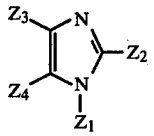

wherein $Z_1$, $Z_2$, $Z_3$ and $Z_4$ independently represent hydrogen, an alkyl group having 5 or less carbon atoms, a hydroxyalkyl group having 5 or less carbon atoms or an alkenyl group having 5 or less carbon atoms; and (ii) a compound represented by the following general formula (I) or (II):

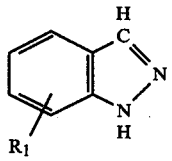

(I)

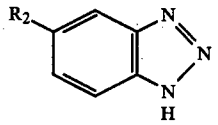

(II)

wherein $R_1$ is hydrogen, a nitro group, a cyano group or a halogen atom; and $R_2$ is hydrogen, a halogen atom or an alkyl group.

2. A method for processing a silver halide photographic light-sensitive material as claimed in claim 1, wherein the compound represented by the general formula (I) or (II) is present in the developing solution in a concentration of 0.02 g to 5.0 g per liter of developing solution.

3. A method for processing a silver halide photographic light-sensitive material as claimed in any of claims 1 or 2, wherein the surface latent image type silver halide emulsion and silver halide emulsion containing fogged nuclei inside the grains are mixed together and contained within a single layer.

4. A method for processing a silver halide photographic light-sensitive material as claimed in any of claims 1 or 2, wherein the surface latent image type silver halide emulsion and silver halide emulsion containing fogged nuclei inside the grains are contained within separate layer on the support.

5. A method for processing a silver halide photographic light-sensitive material as claimed in claim 1, wherein the developing agent is selected from the group consisting of 1-phenyl-3-pyrazolidone and its derivatives, N-methyl-p-aminophenol, and hydroquinone.

6. A method for processing a silver halide photographic light-sensitive material as claimed in claim 1, wherein the silver halide solvent is present in the developing solution in a concentration of 0.01 g to 10 g per liter of developing solution.

7. A method for processing a silver halide photographic light-sensitive material as claimed in claim 1, wherein the developing is carried out over a period from 10 seconds to 2 minutes at a temperature of from 20° C. to 45° C.

* * * * *